US006264753B1

(12) United States Patent
Chao et al.

(10) Patent No.: US 6,264,753 B1
(45) Date of Patent: Jul. 24, 2001

(54) LIQUID CARBON DIOXIDE CLEANING USING AGITATION ENHANCEMENTS AT LOW TEMPERATURE

(75) Inventors: Sidney C. Chao, Manhattan Beach; Edna M. Purer, Los Angeles; Nelson W. Sorbo, Redondo Beach, all of CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/611,454

(22) Filed: Jul. 7, 2000

Related U.S. Application Data

(63) Continuation of application No. 09/526,368, filed on Mar. 16, 2000, now abandoned, which is a continuation-in-part of application No. 09/232,381, filed on Jan. 15, 1999, now abandoned, which is a continuation-in-part of application No. 09/003,913, filed on Jan. 7, 1998, now Pat. No. 5,858,107.

(51) Int. Cl.[7] ..... B08B 5/02

(52) U.S. Cl. ..... 134/1; 134/1.3; 134/2; 134/10; 134/13; 134/32; 134/34; 134/35; 134/40; 134/198; 134/199; 134/200; 134/902; 210/748

(58) Field of Search ..... 134/1, 1.3, 2, 10, 134/13, 32, 34, 35, 40, 198, 199, 200, 902; 210/748

(56) References Cited

U.S. PATENT DOCUMENTS

| | | | | |
|---|---|---|---|---|
| 4,491,484 | * | 1/1985 | Williams | 134/4 |
| 5,467,492 | * | 11/1995 | Chao et al. | 8/159 |
| 5,858,107 | * | 1/1999 | Chao et al. | 134/1 |
| 5,996,155 | * | 12/1999 | Chao et al. | 8/158 |
| 6,004,400 | * | 12/1999 | Bishop et al. | 134/2 |

* cited by examiner

*Primary Examiner*—Sharidan Carrillo
(74) *Attorney, Agent, or Firm*—Colin M. Raufer; Leonard A. Alkov; Glenn H. Lenze, Jr.

(57) ABSTRACT

A cleaning system and method utilizing sonic whistle and other agitation methods to enhance the soil removal and mass transport capacity of the liquid carbon dioxide at low process temperatures. Agitation devices disposed in or couple to a cleaning chamber, and cause the liquid carbon dioxide to ultrasonically emulsify and disperse non-miscible liquids or insoluble solids, such as remove low solubility oils and greases. Cleaning is accomplished at temperatures between −68° F. and 32° F., and the temperature of the liquid carbon dioxide is typically below 32° F.

2 Claims, 3 Drawing Sheets

LIQUID CARBON DIOXIDE CLEANING USING AGITATION ENHANCEMENTS AT LOW TEMPERATURE

CROSS REFERENCE TO RELATED APPLICATIONS

This application is a continuation application of Ser. No. 09/526,368, filed Mar. 16, 2000, now abandoned, which is a continuation-in-part application of Ser. No. 09/232,381, filed Jan. 15, 1999, now abandoned, which is a continuation-in-part application of Ser. No. 09/003,913, filed Jan. 7, 1998, now U.S. Pat. No. 5,858,107.

BACKGROUND

The present invention relates generally to low temperature liquid carbon dioxide cleaning systems and methods, enhanced by vigorous agitation methods, to displace insoluble soils off surfaces, emulsify, disperse and suspend these soils in a liquid carbon dioxide medium for transport and removal.

All cleaning and degreasing solvents currently used present health risks and are environmentally detrimental. For example, perchloroethylene is a suspected carcinogen, petroleum based solvents are flammable and smog producing, 1, 1, 1-trichloroethylene is known to deplete the earth's ozone layer and is scheduled for phase-out.

Liquid carbon dioxide is an inexpensive and unlimited natural resource, that is non-toxic, non-flammable, non-smog-producing or ozone-depleting. Liquid carbon dioxide does not damage fabrics, or dissolve common dyes, and exhibits solvating properties typical of hydrocarbon solvents. Its properties make it a good dry cleaning medium for fabrics and garments and industrial rags, as well as a good degreasing solvent for the removal of common oils and greases used in industrial processes, and a good liquid medium for insoluble soil suspension, dispersion and transport.

One disadvantage of the liquid carbon dioxide as a degreasing solvent is its reduced solvating capability compared to the common degreasing solvents. This deficiency has usually been addressed by the use of chemical additives or co-solvents. These additives increase the cost of operation and must be separated out for disposal, as part of solvent reclamation processing, further increasing operating costs.

Accordingly, it is an objective of the present invention to provide for a liquid carbon dioxide cleaning system and method at low temperatures, enhanced by vigorous mechanical agitation methods to displace, suspend, emulsify and transport the soil away from the substrates to be cleaned.

SUMMARY OF THE INVENTION

To accomplish the above and other objectives, the present invention provides for an improved liquid carbon dioxide cleaning method that comprises jet edge sonic generators as a means of ultrasonically emulsifying and dispersing insoluble solids, and non-miscible liquids in liquid carbon dioxide used in the cleaning system. Agitation via sonic generators is presented as an example, and the present invention does not exclude the use of other high-energy agitation methods at low temperature, such as those generated via using transducers or cavitating blades, propellers, impellers, or nozzles, for example.

The use of the jet edge sonic generators may be used along with other cleaning techniques and the cleaning process can be performed at low processing temperatures.

Typically, cleaning is performed at temperatures between −68° F. and 32° F. The present invention is particularly relevant to processes that utilize liquid carbon dioxide as a degreasing or cleaning solvent or as liquid suspension and dispersion medium.

The present invention reduces the cost of the liquid carbon dioxide degreasing system and process described in U.S. Pat. Nos. 5,339,844 and 5,316,591, respectively, which are assigned to the assignee of the present invention. These savings are due to cost reductions through the physically enhanced transport capacity of the liquid carbon dioxide.

The present invention addresses the replacement of conventional cleaning fluids with liquid carbon dioxide. It also addresses liquid carbon dioxide degreasing of common machined parts or bio-burden removal off of medical devices, prior to sterilization. The present invention improves the mass transport potential of the liquid carbon dioxide by sono-hydrodynamic agitation and other vigorous agitation methods, minimizing the need for solvent enhancing additives.

Because of the enhanced cleaning capabilities of sono-hydrodynamic agitation, effective cleaning is carried out in a low temperature environment, with liquid carbon dioxide temperatures below 32° F. (0° C.). This is particularly useful in the medical field where the moisture containing bio-burden is frozen by the low process temperatures and then displaced by agitation. Because the operating temperature of the present cleaning system is lower than that described previously, the system operating pressure is lower. This lower pressure results in more economical system manufacturing and operation, while maintaining a cleaning level achieved at higher liquid carbon dioxide temperatures and associated higher pressures.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1A:
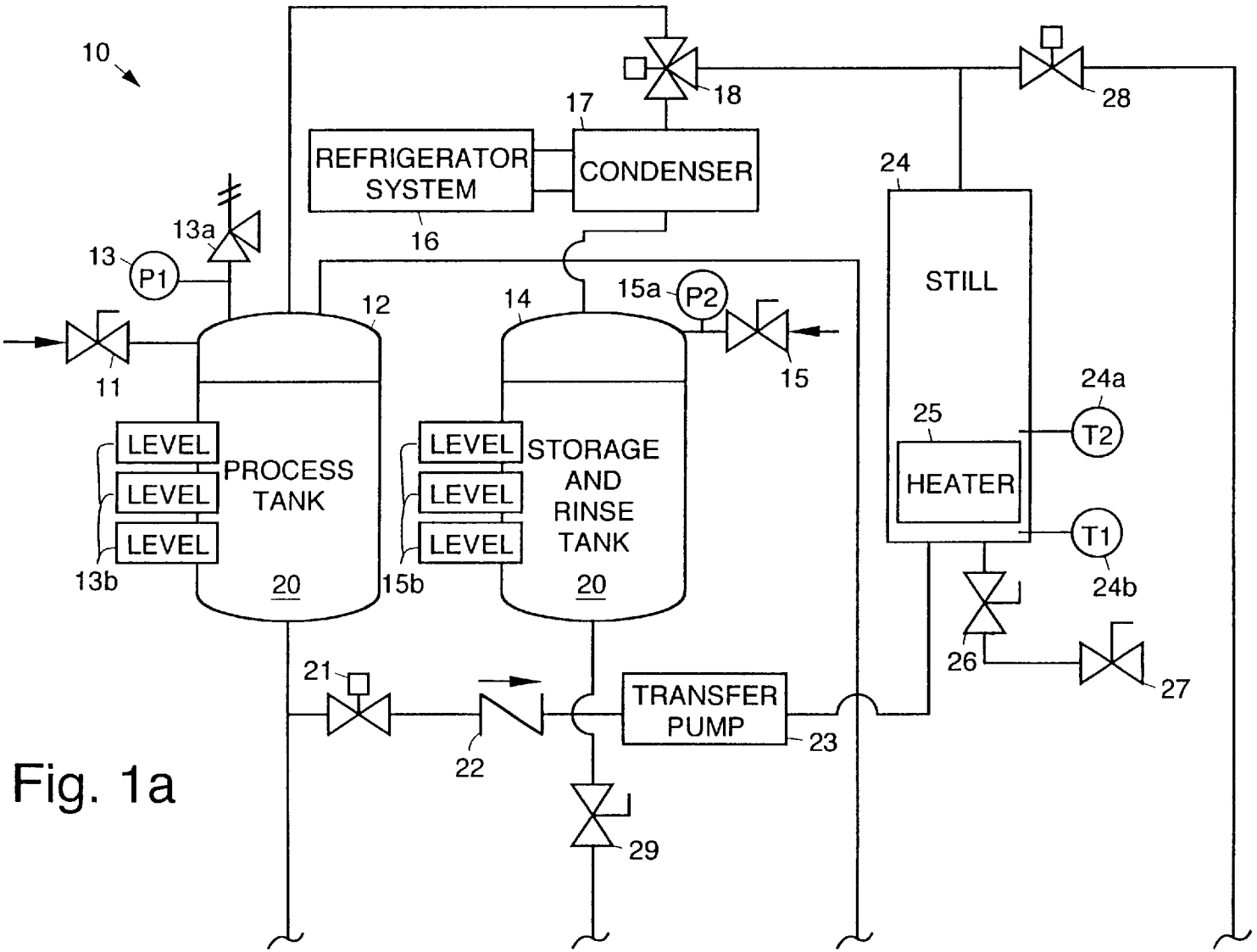
FIGS. 1*a* and 1*b* illustrate a liquid carbon dioxide cleaning system embodying a cleaning method in accordance with the principles of the present invention.
Figure 1B:
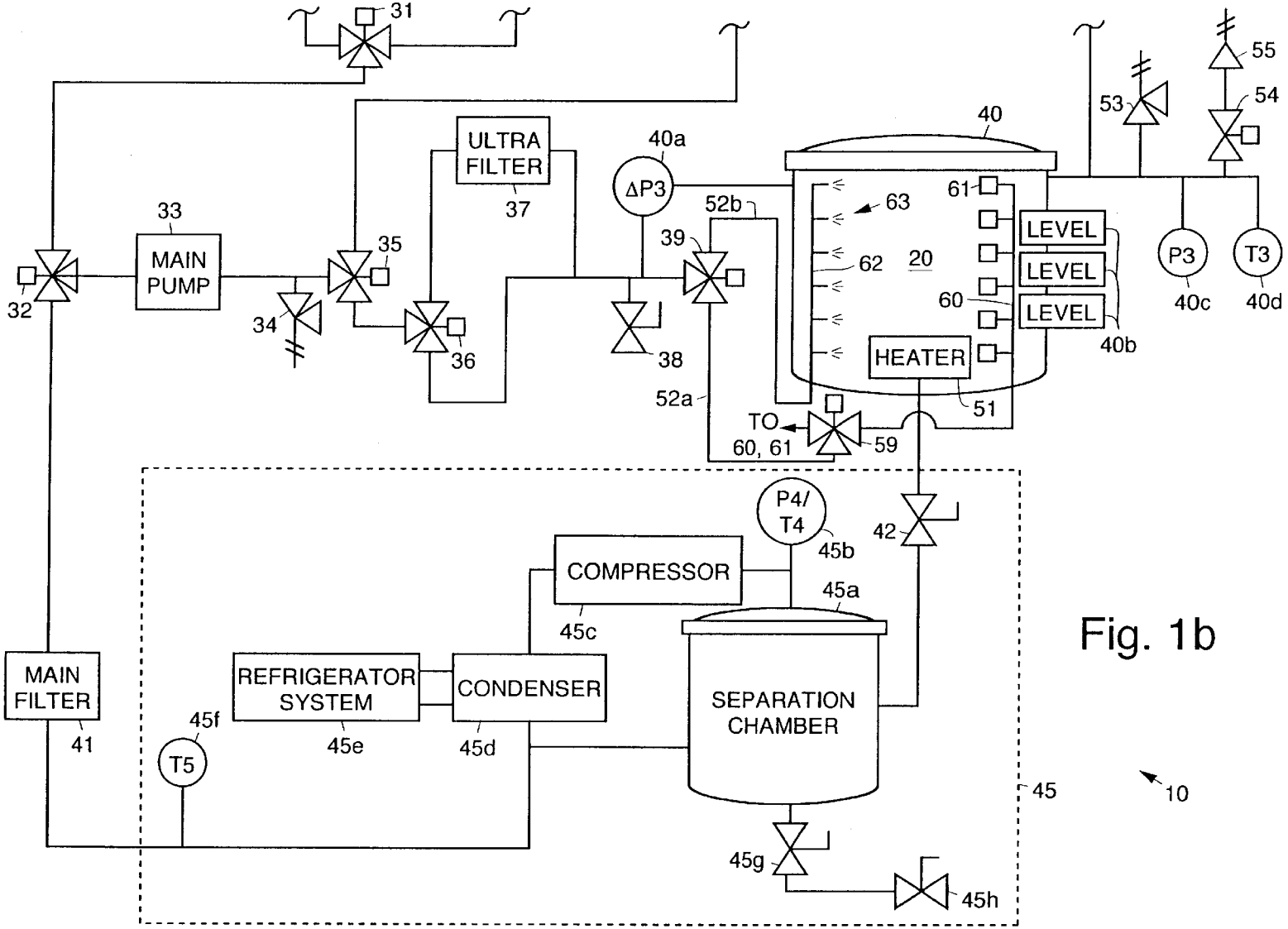

Referring to the drawing figures, FIGS. 1*a* and 1*b* illustrate a liquid carbon dioxide cleaning system 10 embodying a cleaning method in accordance with the principles of the present invention. Referring to FIG. 1*a,* the liquid carbon dioxide cleaning system 10 comprises a process tank fill valve 11 that is coupled to a process tank 12 and that is used to fill the process tank 12 with liquid carbon dioxide 20. A pressure gauge 13 (P1) and pressure relief valve 13*a* are coupled to the process tank 12. Level sensors 13*b* for the process tank 12 are used to monitor the level of liquid carbon dioxide 20 in the process tank 12.

A storage and rinse tank 14 is provided that has a storage tank fill valve 15 and storage tank pressure gauge 15*a* (P2) coupled thereto that are used to fill the storage and rinse tank 14 with liquid carbon dioxide 20. Level sensors 15*b* are used to monitor the level of liquid carbon dioxide 20 in the storage and rinse tank 14.

An output line of the process tank 12 is coupled by way of a first valve 21 and a check valve 22 to a transfer pump 23 whose output is coupled to a still 24 having an internal heater 25. The still 24 has first and second temperature gauges 24*a*, 24*b* (T1, T2) coupled thereto, above and below the heater 25. An output of the still 24 is coupled to an input of a first three-way valve 18. A second output of the still 24 is coupled through two manual check valves 26, 27 that are used to drain the still 24.

A first output of the first three-way valve 18 is coupled to the process tank 12 and is used to pressurize the process tank 12 from the still 26. A second output of the first three-way valve 18 is coupled through a condenser 17 which has a refrigerator system 16 coupled thereto. The output of the condenser 17 is coupled to the storage and rinse tank 14. The output of the storage and rinse tank 14 is coupled to a valve 29.

Referring to FIG. 1*b*, the output of the process tank 12 is coupled to a main pump 33 through second and third three-way valves 31, 32. The output of the storage and rinse tank 14 is also coupled to the main pump 33 through the second and third three-way valves 31, 32. The main pump 33 is connected to either the process tank 12 or the cleaning chamber 40 by way of a fourth three-way valve 35. A pressure relief valve 34 is located downstream of the main pump 33. A fifth three-way valve 36 is located between fourth three-way valve 35 and a cleaning chamber 40 and flow of liquid carbon dioxide 20 from the process tank 12 to the cleaning chamber 40 is sent through an ultra-filter 37 to the cleaning chamber 40.

Figure 3:
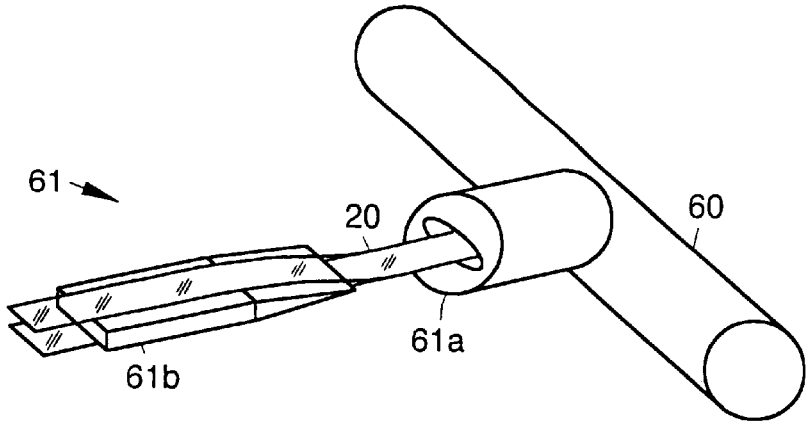
FIG. 3 illustrates details of jet edge sonic generators used in the present invention.

Flow of liquid carbon dioxide 20 to the cleaning chamber 40 is directed through a sixth three-way valve 39, to either a sonic whistle manifold feed pipe 52*a* or a spray nozzle feed pipe 52*b*. The sonic whistle manifold feed pipe 52*a* feeds a seventh three-way valve 59, which in turn feeds a plurality of sonic whistle manifolds 60 located within the cleaning chamber 40, each containing a plurality of sonic whistles 61 that comprise an elliptical nozzle 61*a* and blade 61*b*, as shown in FIG. 3. The sonic whistles 61 are located in a variety of locations and at various angles within the cleaning chamber 40.

The use of sonic whistles 61 in the disclosed embodiment is representative of one of many vigorous agitation techniques that may be used to displace insoluble soils off surfaces, and emulsify, disperse and suspend these soils in a liquid carbon dioxide medium for transport and removal. Other vigorous agitation techniques that may be used in the present invention include ultrasonic cavitation using transducers and hydrodynamic cavitation using blades, propellers, impellers or nozzles, for example.

The spray nozzle feed pipe 52*b* feeds a plurality of spray nozzle manifolds 62 in cleaning chamber 40, each comprising a plurality of spray nozzles 63 located at various locations and at various angles within the cleaning chamber 40. Use of the spray nozzles 63 provide a means of rinsing and flushing parts in the cleaning chamber 40. The cleaning chamber 40 also includes a heater 51 that is used to heat the parts during depressurization step of the cleaning process.

The pressure differential across the sonic whistles 61 and spray nozzles 63 is monitored with a differential pressure sensor 40*a*. The level of the liquid carbon dioxide 20 in the cleaning chamber 40 is monitored by a plurality of level sensors 40*b* located at various locations throughout the cleaning chamber 40. The temperature and pressure in the cleaning chamber 40 are monitored with a pressure sensor 40*c* and temperature sensor 40*d*. The cleaning chamber 40 is equipped with a pressure relief valve 53. Venting of residual gaseous carbon dioxide 20 remaining in the cleaning chamber 40 after cleaning and rinsing is accomplished through a vent control valve 54 and a vent 55. Gas head connections between the cleaning chamber 40 and the still 24, storage and rinse tank 14, and process tank 12 are made through a gas head valve 28 shown in FIG. 1*a*.

The liquid carbon dioxide 20 exits the cleaning chamber 40 and is conveyed to an on-line separation system 45 through a manual valve 42. The on-line separation system 45 comprises the separation chamber 45*a*, a compressor 45*c*, a condenser 45*d*, and a refrigeration system 45*e*. Temperature and pressure in the separation chamber 45*a* are monitored by a sensor 45*b*. The temperature of the liquid leaving the on-line separation system 45 is monitored by a temperature sensor 45*f*. Manual valves 45*g*, 45*h* permit the removal of residue collected in the separation chamber 45*a* without its depressurization. Liquid carbon dioxide 20 leaving the on-line separation system 45 passes through a main filter 41 and to third three-way valve 32.

Figure 2:
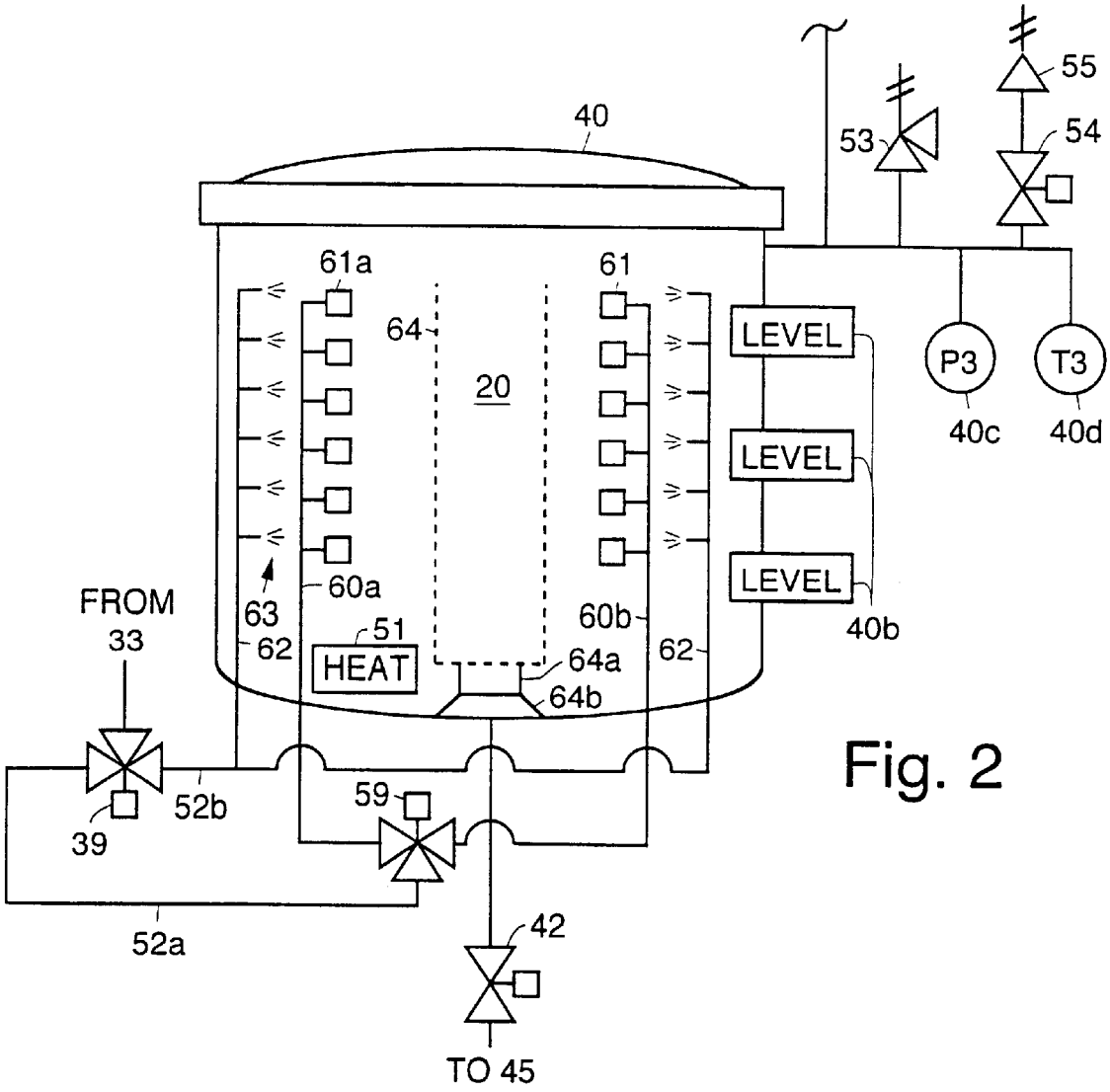
FIG. 2 illustrates a cleaning chamber employing sonolating nozzle manifolds configuration used in the system of FIG. 1.

FIG. 2 illustrates details of the cleaning chamber 40 wherein sonic whistle manifolds 60 fed by the sonic whistle feed pipe 52*a* via the seventh three-way valve 59, and spray nozzle manifolds 62 fed by the spray nozzle feed pipe 52*b*. The seventh three-way valve 59 is used to rapidly switch between two different banks of sonic whistle manifolds 60*a*, 60*b*. The plurality of sonic whistle manifolds 60 feed a plurality of sonic whistles 61 located at various level and angles within the cleaning chamber 40. The sonic whistles 61 comprise an elliptical orifice 61*a* and a blade 61*b* as is shown in FIG. 3. The plurality of sonic whistles 61 are supplied with high pressure liquid carbon dioxide 20 from the main pump 33 through the cleaning chamber valve 39.

Alternatively, liquid carbon dioxide 20 may be sprayed into the cleaning chamber 40 by way of the feed pipe 52*b* which feeds the plurality of spray nozzle manifolds 62 in the cleaning chamber 40, each having a plurality of spray nozzles 63 located at various locations and at various angles within the cleaning chamber 40. Use of the spray nozzles 63 provide a means of rinsing and flushing parts in the cleaning chamber 40.

FIG. 2 also shows a parts basket 64 equipped with a swivel bearing 64*a* and a parts basket mount 64*b*. The parts basket 64 is used to hold or provide a surface on which to mount the parts to be cleaned. The swivel bearing 64*a* permits rotation of the basket 64 due to convective force of liquid carbon dioxide 20 striking the parts basket 64 from either the sonic whistles 61 or the spray nozzles 63, or it may be adjusted to maintain its location, independent of movement of the liquid carbon dioxide 20 within the cleaning chamber 40. The cleaning chamber heater 51 is also depicted in FIG. 2 and provides a means of heating the parts in the cleaning chamber 40 without impeding the movement of the liquid carbon dioxide 20 or the parts basket 64. For completeness FIG. 2 also shows the pressure relief valve 53, the vent control valve 54 and the vent 55, as well as the gas head connections between the cleaning chamber 40 and the still 24, storage and rinse tank 14, and process tank 12 through the gas head valve 28.

Referring to FIG. 3, the present invention addresses the use of sono-hydrodynamic agitation produced by the sonolating nozzle manifolds 52 and the sonic whistles 61 as a means of enhancing the mass transport and solvating potential of the liquid carbon dioxide 20. It is to be understood that other vigorous agitation apparatus and techniques may be used in lieu of the sono-hydrodynamic agitation produced by the sonolating nozzle manifolds 52 and the sonic whistles 61 in the cleaning process. For example, ultrasonic cavitation using transducers and hydrodynamic cavitation using blades, propellers, impellers, or nozzles, for example, may be employed. The sonic whistle manifolds 52*a* couple liquid carbon dioxide 20 to the plurality of elliptical orifices 61a through which the liquid carbon dioxide 20 is forced. The liquid carbon dioxide 20 subsequently passes over the plurality of edges or blades 61*b*. If non-miscible liquids such as oil and water are subjected to intense mechanical agitation, an emulsion or colloid solution is formed as a result of the forces acting at the interface between the two liquids. The sonic whistles 61 ultrasonically emulsify and disperse non-miscible liquids in the liquid carbon dioxide 20 used in the cleaning system 10. Thus, surfaces containing oil or grease may be more easily cleaned using the present cleaning method, as embodied in the exemplary system 10.

Emulsification or dispersion of non-miscible oils and greases is necessary to remove them off parts at low temperatures, using liquid carbon dioxide 20 as a cleaning medium or as liquid suspension and dispersion medium. Certain conditions must be fulfilled before a stable emulsion can be formed. The insoluble component must be broken down into small enough particles in order to form the emulsion. The extent of dispersion increases with the decrease in the viscosity of the medium. When one liquid is dispersed in another to form an emulsion, the rate of settling of the suspended particles is directly proportional to the difference in density compared to the surrounding liquid, and to the square of the diameter of the particles. Theoretical energy requirements are high for high pressure mechanical homogenizers. Typically homogenizers require 40–50 horsepower when processing 1000 gal/hour.

Sonic whistles 61 have been used for ultrasonic emulsification and dispersion. The sonic whistles 61 cause vortices to be formed as a fluid flows through the orifice 61*a* and achieves a measure of stabilization by hydrodynamic feedback between a jet and an edge or blade 61*b*. Sonic radiation can accomplish an equivalent amount of emulsification using only 7 horsepower.

Operation of the sonic whistle 61 is as follows. Liquid carbon dioxide 20 under high pressure is forced through the elliptical orifice 61*a* across the blade 61*b*. The resultant jet of high velocity (approximately 300 feet/second) fluid impinges on the thin blade 61*b* which results in the development of and subsequent shedding of vortices perpendicular to the direction of fluid flow. The vortex shedding creates a steady oscillation of the blade 61*b* in the ultrasonic frequency range. As the fluid tries to fill the minute void space created on either side of the blade 61*b* as it oscillates, zones of intense cavitation are generated. It is the extremely high level of shear force resulting from the collapse of cavitation bubbles that shatters fluids and causes the desired dispersion effects.

The frequency of oscillation is dependent on the free stream flow velocity and the thickness of the blade 61*b*, and to a lesser degree, the Reynolds number of the flow. The flow rate through the nozzle orifice is a simple function of the pressure drop across the nozzle and the fluid density (flow velocity ·(2*Pressure drop/density). Thus for flow velocities necessary to cause ultrasonic agitation, the pressure drop across the sonic whistle 61 is on the order of 700 psi.

The cavitation bubbles generated by the sonic whistle 61 can serve to remove particulate or solid matter off part surfaces, in a manner similar to that commonly observed with ultrasonic generators using piezoelectric crystals, or other means of generating cavitation bubbles. In addition to generating cavitation bubbles in the ultrasonic frequency range, the flow stream has kinetic energy that can be utilized to remove particulate matter and other insoluble materials from the parts. The use of the fluid kinetic energy, also called hydrodynamic agitation, is disclosed in U.S. Pat. No. 5,456,759 entitled "Dry Cleaning of Garments using Liquid Carbon Dioxide under Agitation as Cleaning Medium". In the present invention, the sonic whistles 61 are strategically placed in the chamber to deliver hydrodynamic agitation necessary to remove particulate matter from the surface of parts, generate cavitation bubbles in the ultrasonic frequency range to emulsify insoluble materials already entrained in the fluid, direct the flow stream of cavitating bubbles to surfaces to be cleaned where they collapse, creating intense turbulence and heat, which results in the cleaning of the part, and to circulate bulk fluid around the chamber 40.

The exemplary system 10 also takes advantage of reversible agitation to enhance the turbulence and thus improve mixing, emulsification, and cleaning. The reversible agitation feature of the system 10 occurs as the result generating a vortex of fluid in the chamber 40 using one bank of sonic whistle manifolds 60*b*, and then using the fast switching three-way cleaning chamber valve 59, a second bank of sonic whistle manifolds 60*b* generate a vortex of fluid in the opposite direction. Specific locations of the sonic whistles 61 are staggered vertically so that large volumes of the cleaning chamber 40 are cleaned. The result is intense mixing, turbulence and enhanced cleaning.

Because the use of sonic whistles 61 mechanically enhances the mass transport capability of liquid carbon dioxide 20, the system 10 is capable of effective cleaning at temperatures below 32° F. (0° C.), typically, between −68° F. and 32° F. Operation of the system 10 at low temperatures results in corresponding system pressures that are much lower than the typical operating pressures previously used, ranging from 550 to 800 psi (3.79 to 5.52 Mpa). In the present low temperature cleaning system 10, effective cleaning can occur at temperatures of 0° F. (−16° C.). This corresponds to a system pressure of about 300 psia (2.11 MPa). At this value, the pressure rating of this system 10 is dramatically lowered, and simplified, as this pressure is typically the same as that of standard carbon dioxide dewars, which is utilized worldwide. The exemplary low pressure cleaning system 10 that embodies the present method thus provides for significant system 10, and capital cost savings.

Removal of compounds emulsified by the sonic whistles 61 from the medium 20 occurres by directing the flow of liquid carbon dioxide 20 to the separator 45 which utilizes a low flow condition and lower temperature to encourage agglomeration/coalescence and subsequent separation of these compounds from the liquid carbon dioxide 20. At the low liquid carbon dioxide temperatures described above, agglomeration and coagulation of greases and oils is greatly accelerated.

Using the sono-hydrodynamic agitation generated by the sonic whistles 61, the parts are cleaned and much of the oil and grease are carried away by the liquid carbon dioxide 20 to the on-line separation chamber 45. After the cleaning process is complete, the cleaning chamber 40 is drained by changing the direction of the fourth three-way valve 35 to deliver liquid carbon dioxide 20 back to the process tank 12. To rinse the parts, the second three-way valve 31 is adjusted to draw clean liquid carbon dioxide from storage and rinse tank 14, the fourth three-way valve 35 is readjusted to direct clean carbon dioxide to the cleaning chamber 40 while the cleaning chamber valve 39 is adjusted to deliver clean carbon dioxide 20 to the banks of spray nozzle manifolds 62. A clean high pressure spray of liquid carbon dioxide 20 is delivered through the spray nozzles 63 to the parts in the parts basket 64.

The present method, as embodied in the exemplary system 10 may be used to degrease common machined parts using liquid carbon dioxide 20. The present invention improves the soil removal and mass transport ability of the liquid carbon dioxide 20 by sono-hydrodynamic agitation, minimizing the need for solvent enhancing additives.

Because of the enhanced cleaning capabilities of sono-hydrodynamic agitation provided by the sonic whistles 61, effective cleaning is carried out in a low temperature environment, with liquid carbon dioxide temperatures below 32° F. (0° C.). Because the operating temperature of the present cleaning system 10 and method is lower than that of prior systems and methods, the operating pressure of the system 10 is lower. This lower pressure results in more economical system manufacturing and operation, while maintaining a cleaning level achieved at higher liquid carbon dioxide temperatures and associated higher pressures.

The present invention may also be used to remove bio-burden off of medical devices, prior to sterilization using liquid carbon dioxide 20. Bio-burden is defined as microbial flora that make up the normal contamination on a product. Bio-burden includes material that is biological or organic in nature, i.e., food residue such as is found in dishwashing, or tissue residue, such as is found on surgical or medical implements, or such bio-burden disposed on any surface that may be cleaned using low temperature liquid carbon dioxide cleaning in accordance with the present invention. These types of material contain moisture that freezes at low temperature which facilitates the removal of the solidified bio-burden. Effective cleaning of the bio-burden may be carried out in a low temperature environment, with liquid carbon dioxide temperatures below 32° F. (0° C.), wherein moisture containing bio-burden is frozen by the low process temperatures and then displaced by agitation.

Thus, the present invention may be used to remove bio-burden from substantially any surface on which bio-burden is disposed. In particular, such bio-burden may be removed by cleaning such surfaces using liquid carbon dioxide at temperatures below 32° F. (0° C.). In the present invention, the low temperature is used to solidify the bio-burden disposed on the surfaces which makes it solid. The solid bio-burden is then removed from surfaces using vigorous agitation, such as by cavitation, bubbles, sonic whistles acoustic pressure waves, or ultrasonic agitation, for example.

Thus, an improved liquid carbon dioxide cleaning system that uses jet edge sonic whistles to remove and ultrasonically emulsify and disperse non-miscible liquids or solids in liquid carbon dioxide solvent has been disclosed. It is to be understood that the described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A liquid carbon dioxide cleaning method embodied in a system having a cleaning chamber, said cleaning method comprising the steps of:

providing a cleaning chamber;

disposing vigorous agitation apparatus within the cleaning chamber; introducing liquid carbon dioxide from a storage tank to the cleaning chamber through said vigorous agitation apparatus;

disposing a medical device in the cleaning chamber having one or more surfaces on which bio-burden is disposed; and forcing the liquid carbon dioxide out of the vigorous agitation apparatus at a temperature that is below 32° F. to solidify the bio-burden disposed on the one or more surfaces and remove the bio-burden from the one or more surfaces, and disperse and suspend the bio-burden in the liquid carbon dioxide for transport and removal from the cleaning chamber; and removing the medical device from the cleaning chamber.

2. The cleaning method of claim 1, wherein the temperature of the liquid carbon dioxide is below 32° F. and above −68° F.

* * * * *